US006874714B2

(12) United States Patent
Garvin

(10) Patent No.: US 6,874,714 B2
(45) Date of Patent: Apr. 5, 2005

(54) ROTARY MINERAL BREAKERS

(75) Inventor: Alan Mark Garvin, Cambridge (NZ)

(73) Assignee: Metso Minerals (Matamata) Limited, Matamata (NZ)

( * ) Notice: Subject to any disclaimer, the term of this patent is extended or adjusted under 35 U.S.C. 154(b) by 34 days.

(21) Appl. No.: 10/182,701

(22) PCT Filed: Jan. 26, 2001

(86) PCT No.: PCT/NZ01/00008

§ 371 (c)(1),
(2), (4) Date: Nov. 7, 2002

(87) PCT Pub. No.: WO01/56698

PCT Pub. Date: Aug. 9, 2001

(65) Prior Publication Data

US 2003/0136864 A1 Jul. 24, 2003

(30) Foreign Application Priority Data

Feb. 7, 2000 (NZ) ..... 502725

(51) Int. Cl.[7] ..... B02C 13/282
(52) U.S. Cl. ..... 241/5; 241/275
(58) Field of Search ..... 241/5, 275

(56) References Cited

U.S. PATENT DOCUMENTS 4,940,188 A 7/1990 Rodriguez et al. ..... 241/275

FOREIGN PATENT DOCUMENTS

| | | |
|---|---|---|
| AU | 716034 | 3/1998 |
| WO | WO95/11086 | 4/1995 |
| WO | WO98/56507 | 12/1998 |
| WO | WO98/56508 | 12/1998 |

*Primary Examiner*—Lowell A. Larson
(74) *Attorney, Agent, or Firm*—Jacobson Holman PLLC

(57) ABSTRACT

The invention relates to a rotary mineral breaker, a rotor and a method of using a rotary mineral breaker. The rotary mineral breaker includes a rotor having an inlet for mineral pieces at and/or substantially parallel to the rotary axis thereof from above and at least one peripheral exit port for such materials to exit in the same and/or a modified form radially of the rotor into a surrounding mineral piece interaction zone, the rotor being characterised in that in use for each exit port there will be a retained bed of mineral pieces having (a) a greater vertical extend inwardly of the exit port than at the exit port itself and/or (b) starting higher inwardly that at the exit port itself and being further characterised in that at the trailing boundary of each exit port there is at least a sacrificial member which acts or will act directly or indirectly as a weir for the retained bed of mineral pieces and over which other mineral pieces may be flung, said retained mineral pieces extending inwardly to a backup form which limits the inward intrusion of the retained bed.

6 Claims, 3 Drawing Sheets

ROTARY MINERAL BREAKERS

This is a nationalization of PCT/NZ01/00008 filed Jan. 26, 2001 and published in English.

The present invention relates to rotary mineral breakers.

BACKGROUND

In our PCT International Application Nos. PCT/NZ98/00075 (published as WO 98/56507) and PCT/NZ98/00076 (published as WO 98/56508) we disclosed in respect of rotary mineral breakers the matching of the rotor flow to the surrounding mineral breaking chamber and the contouring of the rotor bed of retained mineral pieces respectively.

The present invention is directed to alternative and/or improved constructions of rotor or rotor assembly (hereafter "rotor") in rotary mineral breakers of the type typified in the aforementioned patent specification (or any of the acknowledged prior art contained therein) with a view to providing rotor bed contouring of retained mineral pieces which better channels whilst accelerating mineral pieces from the substantially vertical in-feed direction to an outward substantially horizontal direction as high speed.

It is an object of the invention to at least duplicate but preferably improve upon the loci of movement disclosed in WO 98/56508 as disclosed in respect of FIGS. 2, 4B to 4F and 7 of that patent specification, or alternatively to provide a useful alternative.

STATEMENT OF INVENTION

The present invention in one aspect can broadly be said to consist in a rotary mineral breaker of a kind having a rotor to rotate about a substantially vertical rotary axis, the rotor having an inlet for mineral pieces at and/or substantially parallel to the rotary axis thereof from above and at least one peripheral exit port for such materials to exit in the same and/or a modified form radially of the rotor into a surrounding mineral piece interaction zone, the rotor being characterised in that in use for each exit port there will be a retained bed of mineral pieces having (a) a greater vertical extent inwardly of the exit port than at the exit port itself and/or (b) starting higher inwardly that at the exit port itself and being further characterised in that at the trailing boundary of each exit port there is at least a sacrificial member which acts or will act directly or indirectly as a weir for the retained bed of mineral pieces and over which other mineral pieces may be flung, said retained mineral pieces extending inwardly to a backup form which limits the inward intrusion of the retained bed.

Preferably a distributor structure at or about the rotation axis of the rotor is provided on or as part of a base member, such distributor structure (whether by virtue of a conical or other form) having the effect of deflecting centrally dropping mineral pieces towards each trailing bed of retained mineral pieces and/or to allow the bed to build towards and/or to it.

Preferably the rotor includes an upper surface at least inwardly of the exit ports which rises centrally to an axial intake port.

Preferably the rotor includes a frustoconical or inverted bowl like shape upper surface to ensure and/or allow a greater vertical height of retained bed of mineral pieces than at and adjacent each exit port.

Preferably the structure of the rotor includes one or more of the components and/or sub-assemblies or components or sub-assemblies substantially as hereinafter described with reference to any one or more of the accompanying drawings.

In still a further aspect the present invention is a rotor suitable for a rotary mineral breaker having a main structure from which depends exit port defining assemblies which includes at least one sacrificial component to act (at least in part) directly or indirectly as a weir, the arrangement being such that (preferably in conjunction with an inward geometry, an inwardly rising roof, and an inwardly rising base) a locus of curvature over a retained bed of mineral pieces is achieved for each exit port, such locus commencing in a region of the retained bed that is higher than the upper reaches of said part.

In still a further aspect the present invention consists in a method of operating a rotary mineral breaker which comprises feeding mineral pieces to be broken into the rotor of such a mineral breaker and by appropriate assembly of the bed retaining geometries at (I) the exit port, (ii) the inner region of the retained bed, and (iii) above, (iv) below and (v) behind the retained bed, a retained bed of a form characterised by FIG. 2 hereof is obtained.

DESCRIPTION OF THE DRAWINGS

The invention consists in the foregoing and also envisages constructions of which the following gives examples.

The preferred form of the present invention will now be described with reference to the accompanying drawings in which.

In the preferred form of the present invention the sacrificial components are of a kind exemplified in our aforementioned specifications.

In the present invention however the rotor preferably comprises a base member 1 having a distributor cone or other structure 2 at or adjacent the rotational axis below the intake port 3 through the preferably frustoconical or the like roof or cover or top 4.

Figure 1:
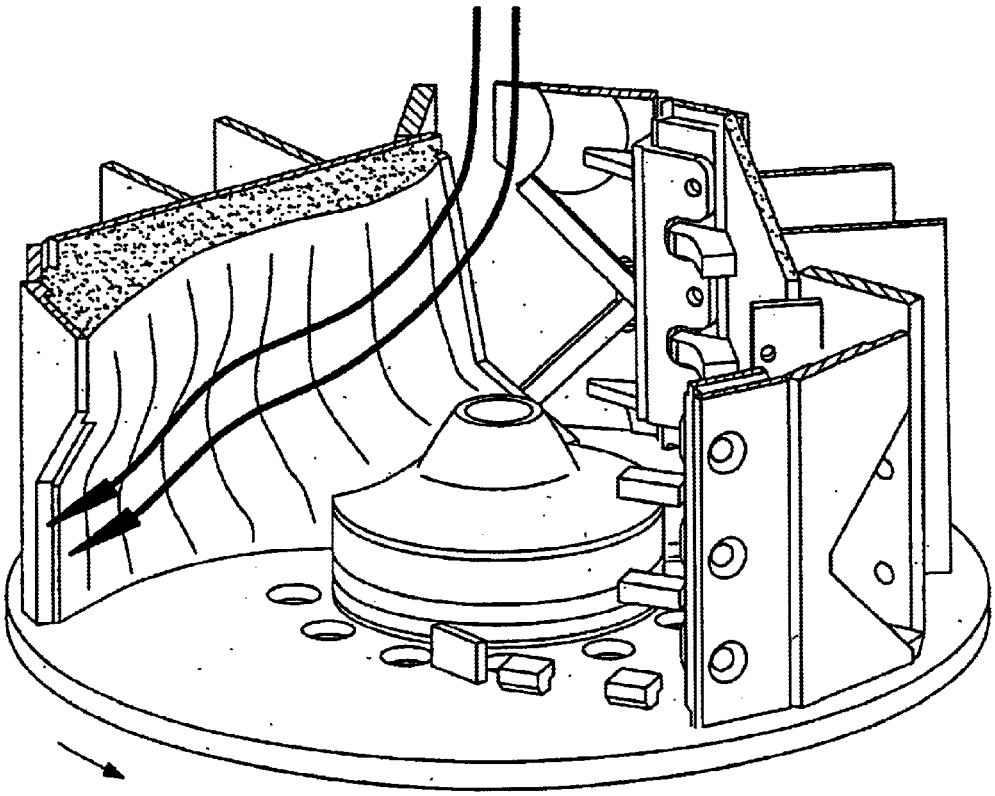
FIG. 1 (PRIOR ART)
FIG. 1 shows (with a substantially flat roof type member removed) our prior art rotor having a flat base with a distributor member centrally therein and which by virtue of oppositely configured exit port weir to the inward bed confinement members is able to configure a channel conducive to providing a loci of mineral pieces over the retained bed over the sacrificial weir at the exit port in the manner depicted by the arrows.
Figure 2:
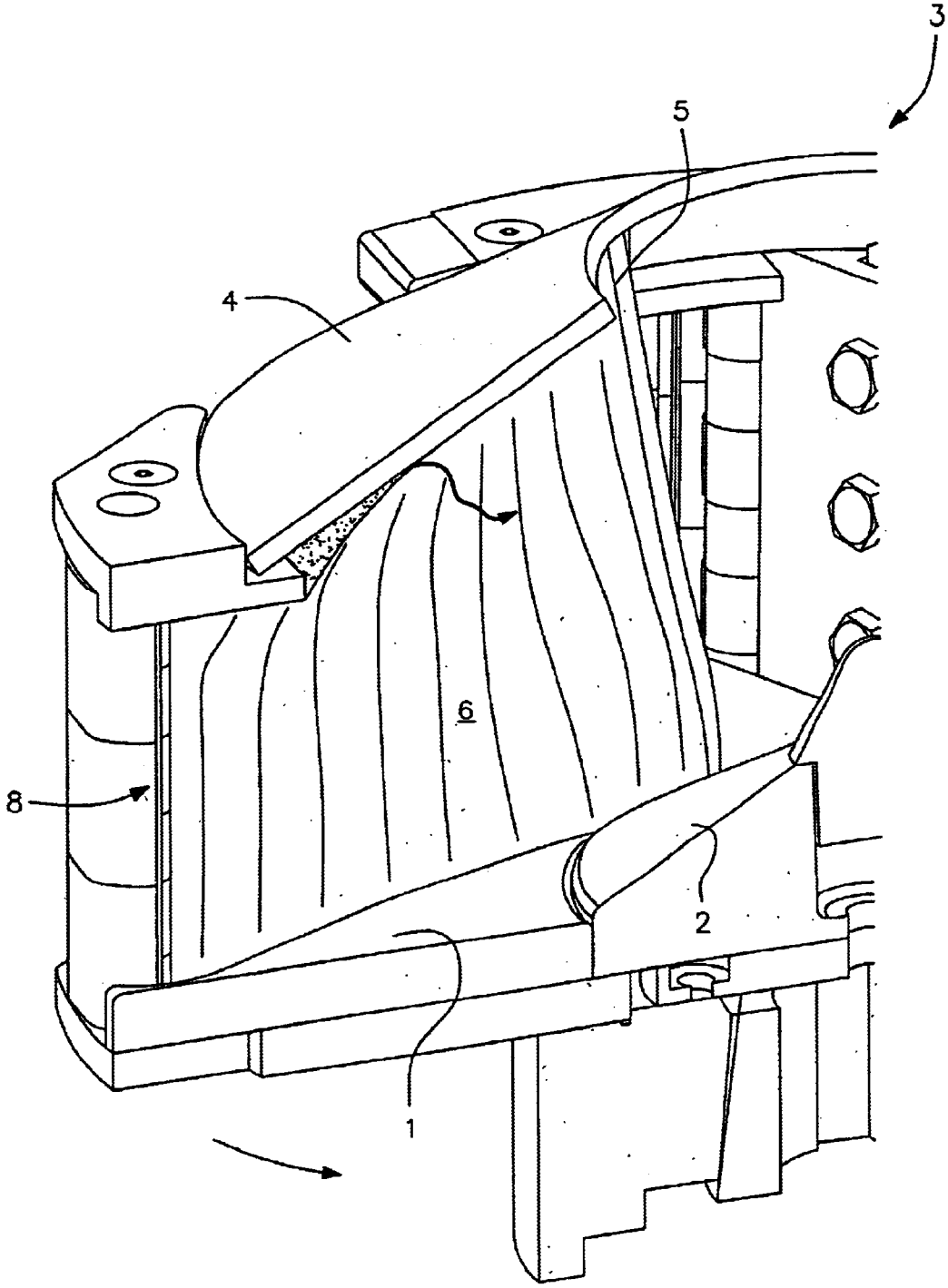
FIG. 2 shows an alternative arising from the use of the present invention (the rotor being adapted to rotate in the same direction as the prior art rotor of FIG. 1, ie; in the arrowed direction) but having a retained bed that has a greater height centrally than at and adjacent the exit port arising from the use of a back up member which defines the inner bounds of the retained bed but which by virtue of its extending up towards a raised roof structure can provide a greater height as is desirable to better provide a curved locus from the central region out to the exit port.
Figure 3:
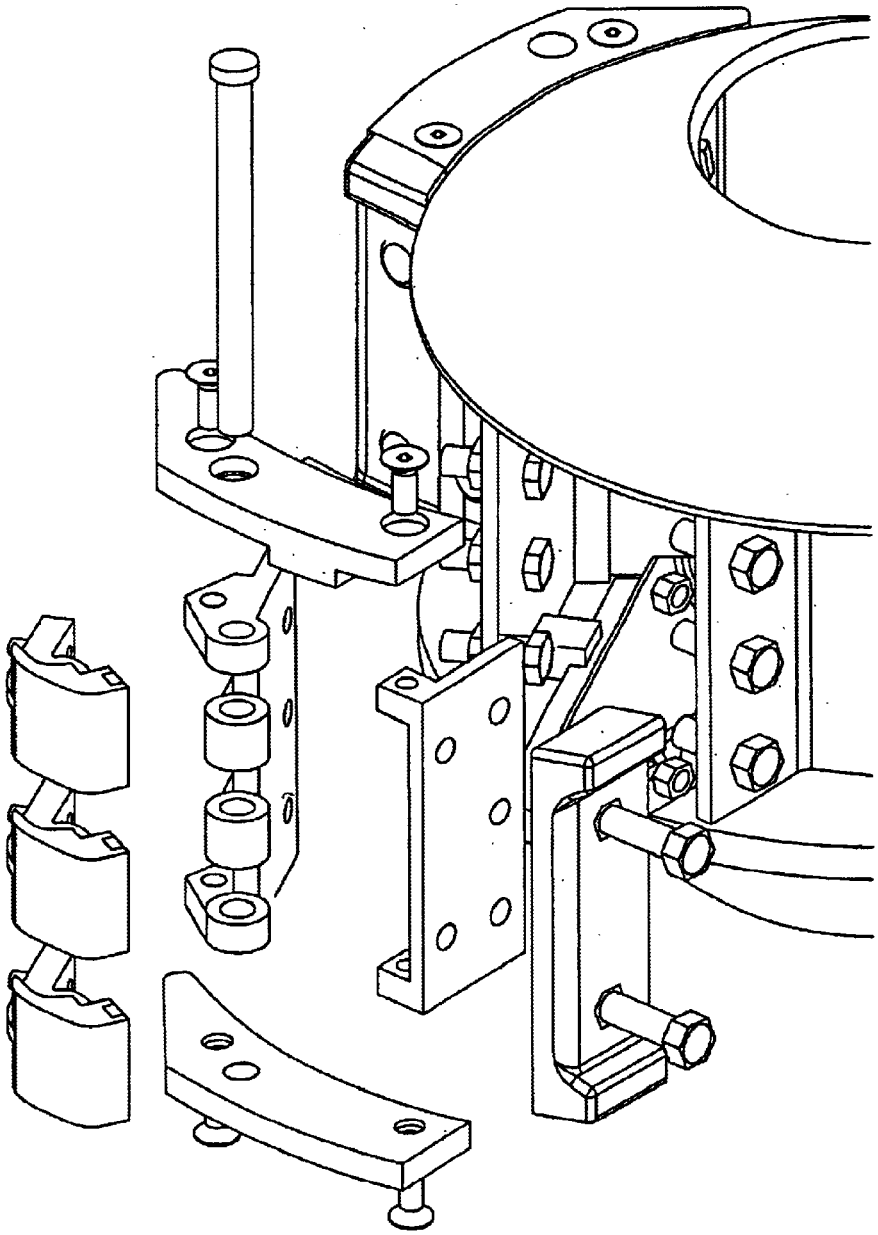
FIG. 3 shows a preferred form of componentry of structure for providing a rotor in accordance with the present invention.

Extending between the roofing member or substantially between the roofing member 4 and the base member 1 is a backing member 5 which protrudes closer to the distributor member 2 at its bottom end than at the top so as to configure a retained bed 6 in the manner depicted in conjunction with the effect of the interface 7 provided by the member 4 and the weir arrangement 8 which it is to be noted preferably does not require the localising configurations of the prior art form of FIG. 1 as disclosed in some detail in WO 98/56508.

The present invention therefore envisages structures whereby a rotor might be provided with a centrally rising base and an inwardly rising roof or cover member and which has in conjunction therewith an array of bed form determining members at least one of which acts as a weir and one of which is a bed backing member typified by, for example, member 5.

Persons skilled in the art will appreciate how without any substantial increase in the vertical height of the rotor at and/or adjacent its spinning periphery (but with preferably some raising of the upper regions of the rotor inwardly thereof) all of the desirable loci features disclosed in WO 98/56508 can be obtained and enhanced.

What we claim is:

1. A rotary mineral breaker comprising:

a rotor to rotate about a substantially vertical rotary axis, the rotor having an inlet for mineral pieces, the inlet being substantially parallel to the rotary axis thereof from above and at least one peripheral exit port for the mineral pieces to exit in a modified form radially of the rotor into a surrounding mineral piece interaction zone, and, in use, for each exit port there is a retained bed of mineral pieces having (a) a greater vertical extent inwardly of the exit port than at the exit port, and (b) starting higher inwardly at the exit port, and at a trailing boundary of each exit port there is at least a sacrificial member acting as a weir for the retained bed of mineral pieces and over which other mineral pieces may be flung, said retained mineral pieces extending inwardly to a backup form which limits inward intrusion of the retained bed.

2. The rotary mineral breaker as claimed in claim 1, wherein a distributor structure of the rotor is provided at one of on and as part of a base member, the distributor structure having the effect of deflecting centrally dropping mineral pieces.

3. The rotary mineral breaker as claimed in claim 1, wherein the rotor includes an upper surface at least inwardly of the exit ports which rises centrally to an axial intake port.

4. The rotary mineral breaker as claimed in claim 1, wherein the rotor includes one of a frustoconical and inverted bowl shape upper surface.

5. A rotor for a rotary mineral breaker, said rotor comprising a main structure from which depends exit port defining assemblies, the exit portion defining assemblies include at least one sacrificial component to act, at least in part, as a weir, an arrangement of the rotor being such that a locus of curvature over a retained bed of mineral pieces is achieved for each exit port, the locus commencing in a region of the retained bed that is higher than upper reaches of said port.

6. A method of operating a rotary mineral breaker, said method comprising the steps of feeding mineral pieces to be broken into a rotor of the rotary mineral breaker, and assembling bed retaining geometries at (i) an exit port, (ii) an inner region of a retained bed, (iii) above the retained bed, (iv) below the retained bed, and (v) behind the retained bed, the retained bed having (a) a greater vertical extent inwardly of the exit tort than at the exit port, and (b) starting higher inwardly at the exit port, and at a trailing boundary of each exit port there is at least a sacrificial member acting as a weir for the retained bed of mineral pieces and over which other mineral pieces may be flung, said retained mineral pieces extending inwardly to a backup form which limits inward intrusion of the retained bed.

* * * * *